US009624740B2

(12) United States Patent
Molski

(10) Patent No.: US 9,624,740 B2
(45) Date of Patent: Apr. 18, 2017

(54) HYDRAULIC PIPE HANDLING APPARATUS

(71) Applicant: Tammy Sue Molski, Central Lake, MI (US)

(72) Inventor: Tammy Sue Molski, Central Lake, MI (US)

( * ) Notice: Subject to any disclaimer, the term of this patent is extended or adjusted under 35 U.S.C. 154(b) by 0 days.

(21) Appl. No.: 14/315,790

(22) Filed: Jun. 26, 2014

(65) Prior Publication Data

US 2015/0030415 A1 Jan. 29, 2015

(51) Int. Cl.
*E21B 19/00* (2006.01)
*E21B 19/15* (2006.01)

(52) U.S. Cl.
CPC ..... *E21B 19/15* (2013.01)

(58) Field of Classification Search
CPC ..... E21B 19/00; E21B 19/14; E21B 19/155
USPC ..... 414/22.51–22.71
See application file for complete search history.

(56) References Cited

U.S. PATENT DOCUMENTS 3,053,401 A * 9/1962 Jinkins, Jr. ..... E21B 19/155 414/22.59
4,051,956 A * 10/1977 Teague ..... 414/746.4
4,347,028 A * 8/1982 Dugan ..... E21B 19/155 414/22.61
4,684,314 A * 8/1987 Luth ..... 414/746.1
4,709,766 A * 12/1987 Boyadjieff ..... 175/52
5,451,129 A * 9/1995 Boyadjieff ..... B65G 1/0442 414/22.61
6,079,925 A * 6/2000 Morgan et al. ..... 414/22.57
6,533,519 B1 * 3/2003 Tolmon ..... E21B 19/155 175/85
6,877,942 B2 * 4/2005 Eastcott ..... 414/22.54
7,625,168 B2 * 12/2009 Lesko ..... E21B 19/15 198/468.6
7,918,636 B1 * 4/2011 Orgeron ..... 414/22.55
8,033,779 B2 * 10/2011 Gerber ..... E21B 19/15 14/71.1
8,052,368 B2 * 11/2011 Littlewood et al. ..... 414/22.52
8,215,887 B2 * 7/2012 Fikowski et al. ..... 414/22.58
8,317,239 B2 * 11/2012 Martin ..... B60R 19/38 293/102
8,474,892 B1 * 7/2013 Hanna ..... 294/68.3
8,506,229 B2 * 8/2013 Orgeron ..... 414/22.55
2003/0170095 A1 * 9/2003 Slettedal ..... 414/22.59
2005/0152772 A1 * 7/2005 Hawkins, III ..... E21B 19/155 414/22.54
2006/0045655 A1 * 3/2006 Wells ..... 414/22.61
2009/0056932 A1 * 3/2009 Lesko ..... E21B 19/15 166/77.52
2009/0127001 A1 * 5/2009 Felt ..... 175/85
2009/0252576 A1 * 10/2009 Gerber et al. ..... 414/22.54
2012/0130537 A1 * 5/2012 Gerber ..... E21B 19/15 700/244

* cited by examiner

*Primary Examiner* — Michael McCullough
*Assistant Examiner* — Lynn Schwenning
(74) *Attorney, Agent, or Firm* — Foster Swift Collins & Smith PC; Zachary W. Behler

(57) ABSTRACT

A pipe handling apparatus comprising an operator station, a hydraulic pipe pusher assembly, hydraulic bumper light bar, hydraulic pipe gates, hydraulic telescoping pipe table, hydraulic pipe racks, hydraulic leveling jacks, hydraulic pipe loader, main lift hydraulic cylinder, and the trailer base.

20 Claims, 9 Drawing Sheets

HYDRAULIC PIPE HANDLING APPARATUS

FIELD OF THE INVENTION

This present invention relates to a pipe handling apparatus capable of manipulating up to sixteen (16) joints of pipe at a time and other tubular items that are commonly maneuvered on an oil and gas well site.

BACKGROUND

In the oil and gas industry, pipe and other tubular items are regularly hoisted vertically from the pipe racks on the ground to a work basket on the derrick which is typically 5 to 37 feet above the ground depending on the type of rig used. The pipe is then typically run down the well by the snubbing unit or workover rig from the work basket. There are also occasions when the process is reversed and the pipe must be retrieved from the work basket back down to the ground and placed on pipe racks.

The oil and gas industry is a hazardous occupation. The need for reliable and safe manipulation of pipe and other tubular items is significantly warranted to maintain a safe work environment for all workers on the well site. In addition, it is vital to keep production at its peak performance. Traditionally, pipe was manipulated via boom and cable type apparatuses which were dangerous to the rig hand and could potentially damage the pipe. To solve these problems pipe handlers were designed to carry one (1) joint of pipe at a time via a trough type carriage. Further, pipe handlers were typically chain driven.

This invention satisfies both major components. It increases productivity by manipulating up to sixteen (16) joints of pipe securely in a single trip without damaging the pipe and it accomplishes the safety factor by controlling the amount of round trips to the work basket as well as giving the derrick hand an additional escape route in case of an emergency.

SUMMARY OF THE INVENTION

The inventive pipe handling apparatus comprises a novel pipe manipulation system. The inventive pipe handling apparatus includes an operator's tower and it has a metal roof overhead for the operator's protection as well as an emergency shut down on all hydraulics at his fingertips and a kill switch on the motor should an occasion arise requiring such an action. The pipe delivery section (hydraulic pipe table) holds up to sixteen (16) joints of pipe or tubular items per trip to the work basket, the hydraulic pipe table doubles as an alternative escape route in case of an emergency for the derrick hand in the work basket. The loading arm can load up to 4 joints of pipe onto the hydraulic pipe table at a time reducing the time it takes to fully load the hydraulic pipe table. Because this machine lifts 16 joints of pipe/tubing at a time (current pipe handlers must make 16 trips to equal our 1) the reduction of trips increases productivity and saves wear and tear on the apparatus as well as increasing the safety aspect with reduced motion. My unit is raised and lowered as well as pipe delivery hydraulically rather than the chain driven ones currently used. This unit can also serve as a temporary pipe/tubing storage area.

A heavy truck outfitted with a fifth wheel hook up hauls and sets the pipe handling apparatus on a gas or oil well location. The operator levels out the apparatus via four (4) hydraulic cylinders around the base.

A loader hauls and places the pipe racks and the pipe rack stabilizer bar while the operator installs the pins to swing them into place. This step is completed on both sides of the apparatus for a total of four (4) times.

A loader loads the hydraulic pipe racks with the pipe or other tubular items being utilized by the snubbing unit or workover rig. The trained operator supplied for this pipe handling apparatus then hydraulically maneuvers the pipe rack to roll toward the hydraulic pipe loader and tilts the hydraulic pipe table to roll the pipe or other tubular items to the opposite side of the hydraulic pipe table for easy loading. The hydraulic pipe loader picks up four (4) joints of pipe or other tubular items and rolls them onto the hydraulic pipe table, this is repeated 3 more times. Now the hydraulic pipe table is full with sixteen (16) joints of pipe or other tubular items. The operator hydraulically lifts the hydraulic pipe gate to secure the load and levels out the hydraulic pipe table.

The operator sets the angle required to reach the work basket on the incline gauge, he then hydraulically lifts the pipe table vertical until the desired angle is achieved. The operator then engages the hydraulic pipe pusher to extend out to the work basket. It takes about two (2) minutes to load, lift and extend the table into place for the derrick hand.

The operator holds the aforementioned position until the derrick hand has used all sixteen (16) joints of pipe or other tubular items. Once the last joint has been removed from the hydraulic pipe table it is lowered back down to the base and the steps repeat.

DETAILED DESCRIPTION OF THE INVENTION

Figure 1:
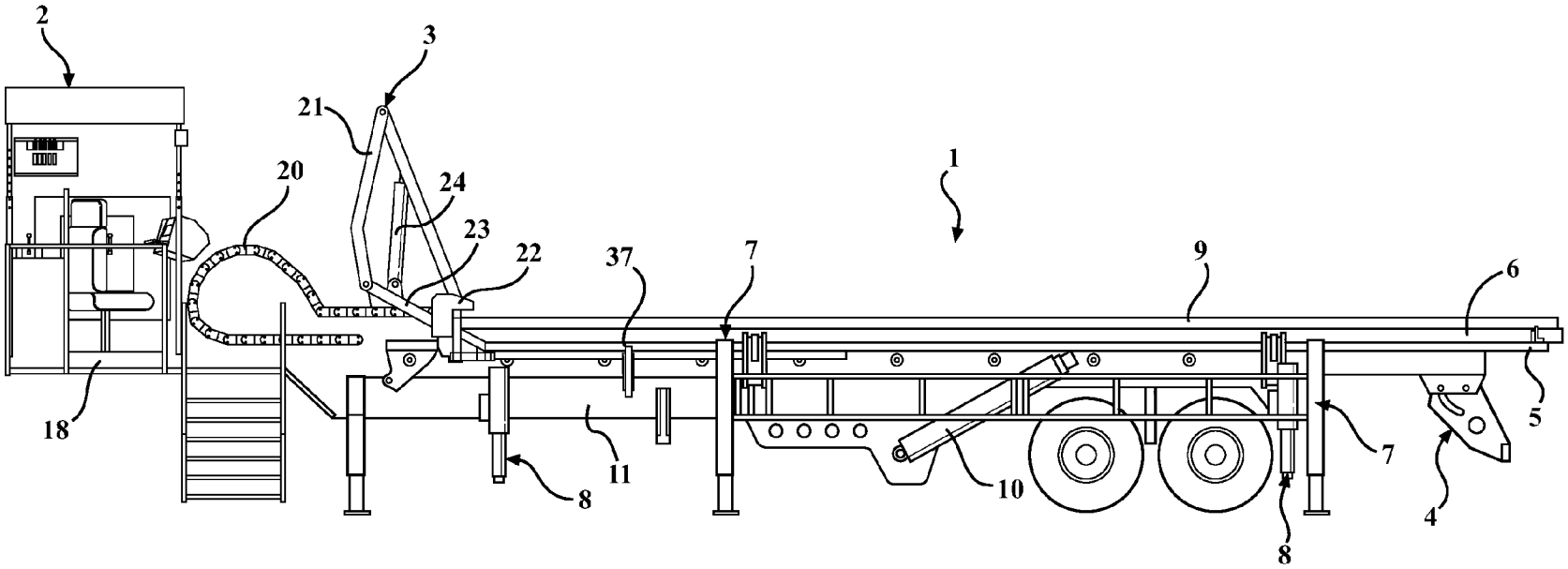
FIG. 1 is a side view with the hydraulic pipe handing apparatus in the lowered position from the operator station to the tail roller.

FIG. 1 is a side view of the pipe handling apparatus 1 in the lowered position. The pipe handling apparatus 1 includes an operator station 2, a hydraulic pipe pusher assembly 3, hydraulic bumper light bar 4, hydraulic pipe gates 5, hydraulic telescoping pipe table 6, hydraulic pipe racks 7, hydraulic leveling jacks 8, hydraulic pipe loader 9, main lift hydraulic cylinder 10, and the trailer base 11.

The operator station 2 is configured to allow the user to operate the pipe handing apparatus 1 from a single location.

Figure 2:
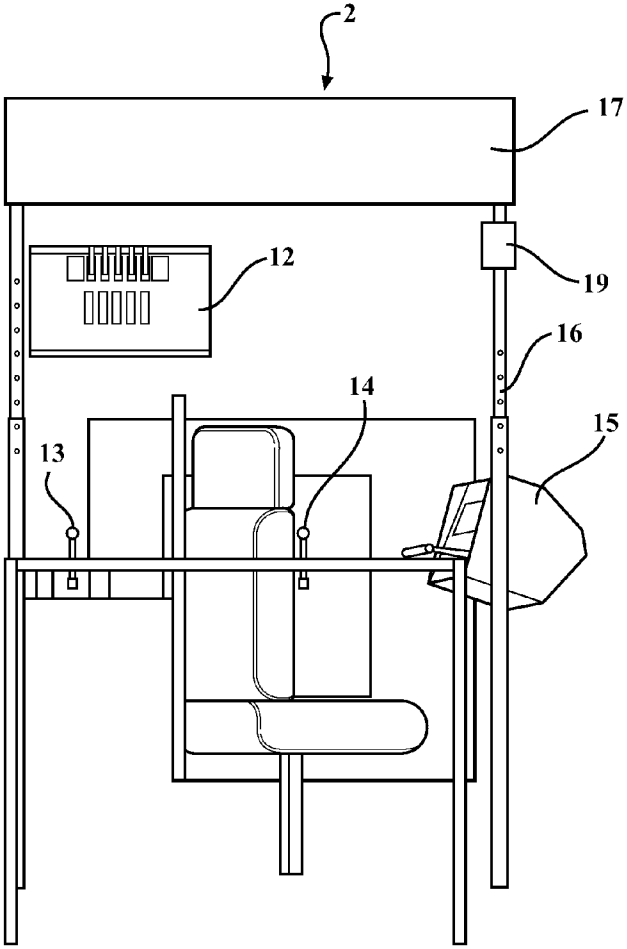
FIG. 2 is a side view of the operator station.

The operator station 2 has complete control over all hydraulically driven aspects of this pipe handling apparatus 1. FIG. 2 is a side view of the operator station 2 from side view. As depicted in FIG. 2, the operator station 2 may include hydraulic controls 12 to maneuver the hydraulic leveling jacks 8 that may be used to level the entire apparatus 1 to the contours of a specific location. The hydraulic controls 12 may additionally be configured to control the hydraulic bumper light bar 4. The operator station may additionally include main elevation controls 13 that may be used to extend the main hydraulic lift cylinder 10 to lift the hydraulic telescoping pipe table 6. Pipe telescoping controls 14 may be included in the operator station 2 used by the operator to extend the hydraulic pipe pusher 3. Once the hydraulic pipe pusher 3 is fully extended, the pipe telescoping controls 14 may be used to extend the telescoping pipe table 6. Additionally, pipe rack hydraulic controls 15 may operate the hydraulic pipe racks 7 on both the left and right side of the apparatus 1. The operator station 2 is constructed with welded steel compartments, preferably including a height adjustable steel frame 16 securing the stainless steel roof 17, as well as a welded diamond plate steel floor 18. A LED light 19 may be added to the operator station 2 to aid the operator in operation of the apparatus 1 at night.

Figure 3:
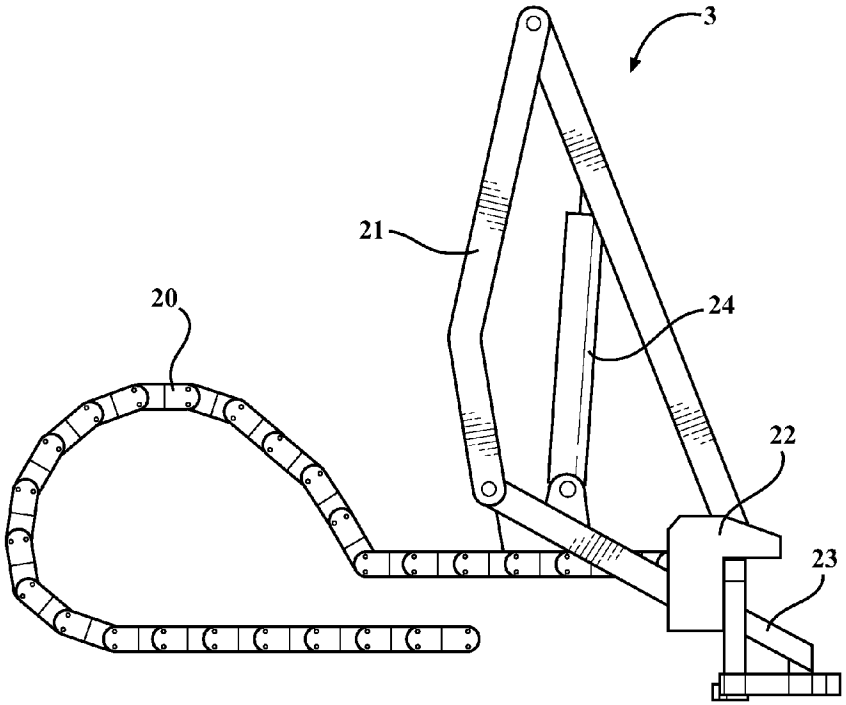
FIG. 3 is a side view of the hydraulic pipe pusher.

The pipe pusher assembly 3 is used to extend and retract the pipe over the end of the hydraulic telescoping pipe table 6 vertically to the workbasket on the derrick. FIG. 3 is a side view of the hydraulic pipe pusher. As depicted in FIG. 3, a hydraulic hose track 20 is utilized to protect the rubber hydraulic hoses encapsulated inside the track 20. In the preferred embodiment, the hydraulic hose track 20 is constructed from riveted stainless steel to provide flexibility during the extension process. The pipe pusher scissor main assembly 21 is used to facilitate the movement of the pipe pusher head assembly 22 and the pipe pusher gantry assembly 23 vertically along the telescoping pipe table 6. In the preferred embodiment, the pipe pusher scissor main assembly 21 is constructed from welded steel with metal pins to provide bendability, vertically when extended. The pipe pusher hydraulic cylinders 24 provide the pipe pusher assembly 3 with hydraulically powered maneuverability. The pipe pusher head assembly 22 engages pipe resting on the hydraulic telescoping pipe table 6 and pushes the pipe vertically along the hydraulic telescoping pipe table 6. In the preferred embodiment, the pipe pusher head assembly 22 is constructed from welded steel. The pipe pusher head assembly 22 also houses the pipe pusher gantry assembly 23. The pipe pusher gantry assembly 23 supports the pipe pusher scissor assembly 21 and facilitates is connection with the hydraulic telescoping pipe table 6. In the preferred embodiment, the pipe pusher gantry assembly 23 is constructed from welded steel.

Figure 4:
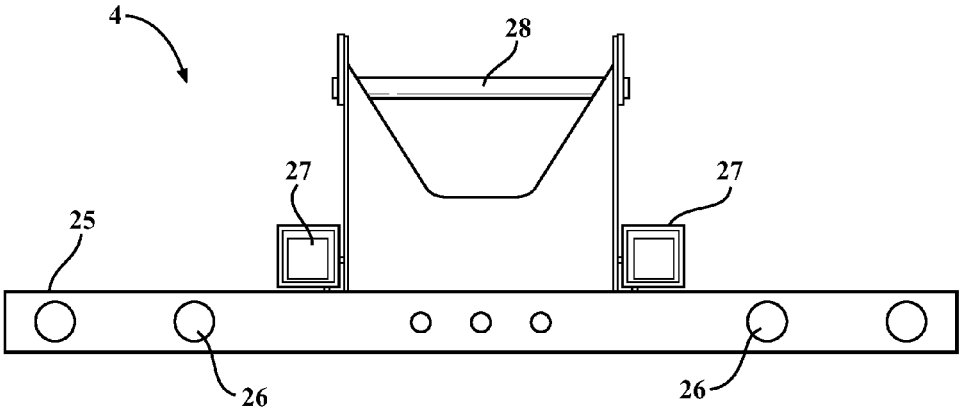
FIG. 4 is a rear view of the hydraulic bumper light bar.

The hydraulic pipe handling apparatus 1 may also include a hydraulic bumper light bar 4 to comply with applicable highway safety regulations. FIG. 4 is front view of the hydraulic bumper light bar 4. The hydraulic bumper light bar 4 includes a main bumper bar 25 that provides a medium for properly mounting Department of Transportation regulation compliant lighting assemblies 26. In the preferred embodiment, the hydraulic bumper light bar 4 is constructed from welded steel for strength. Optionally, LED lights 27 may be mounted on the main bumper bar 25 to provide ample lighting for safe operation of the hydraulic pipe handling apparatus during dusk and dark hours. The light assembly 26 has a dual purpose. Its first function is providing regulatory compliant tail lights, brake lights and turn signals; its second function is to visually alert personnel on the well site that the pipe handling apparatus 1 is in motion. Audio alerts may be utilized as well. The hydraulic bumper light bar 4 additionally comprises a main pivot shaft 28 allowing the hydraulic bumper light bar 4 to fold to the appropriate angle during operation of the pipe handling apparatus 1 and return to the perpendicular position during transport for accurate use of the DOT light assembly 26.

Figure 5:
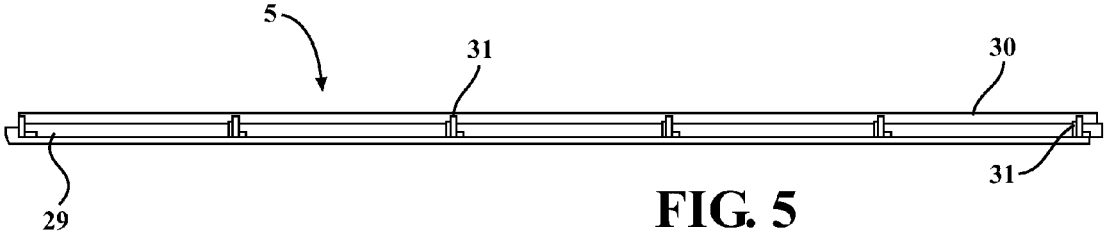
FIG. 5 is a side view of the hydraulic pipe gates.

The hydraulic pipe handling apparatus 1 additionally comprises two hydraulic pipe gates 5. The function of the hydraulic pipe gates 5 is to lower when loading pipe and raise to secure pipe on the hydraulic telescoping pipe table 6. FIG. 5 is a side view of a hydraulic pipe gate 5. As depicted in FIG. 5, a hydraulic pipe gate cylinder 29 is used to extend and retract the hydraulic main gate tube 30. The hydraulic main gate tube 30 is utilized to restrain the lateral movement of the pipe on the hydraulic telescoping pipe table 6 when the hydraulic pipe gate cylinder 29 is in the retracted position. When the hydraulic pipe gate cylinder 29 is extended, the hydraulic pipe gate pivot assemblies 31 convert the horizontal motion of the hydraulic pipe gate cylinder 29 to rotational motion to allow the hydraulic main gate tube 30 drop below the level of the hydraulic telescoping pipe table 6 freeing the pipe to move laterally. In the preferred embodiment, the hydraulic pipe gate pivot assemblies 31 are constructed from welded steel with steel pins to achieve the ability to pivot.

Figure 6:
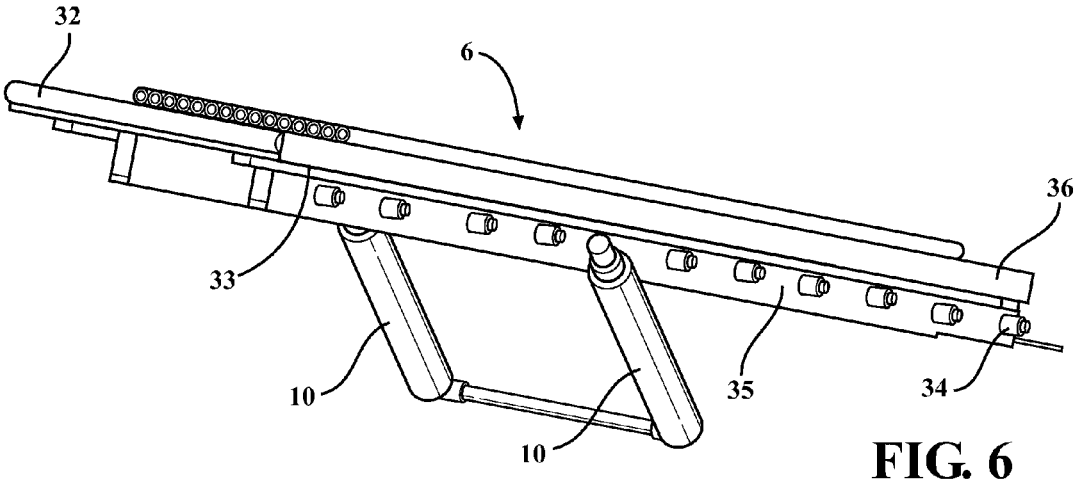
FIG. 6 is a side view of the hydraulic telescoping pipe table.

The hydraulic pipe handling apparatus 1 additionally comprises hydraulic telescoping pipe table 6. The function of the hydraulic telescoping pipe table 6 is to facilitate the vertical movement of the pipe from the ground to the work basket on the derrick. FIG. 6 is a side view of the hydraulic telescoping pipe table 6. As depicted in FIG. 6, a tail roller 32 is fitted to the end of the hydraulic telescoping pipe table 6 and aides in the pipe removal process for the derrick hand in the work basket. The hydraulic telescoping pipe table 6 additionally comprises two main lift hydraulic cylinders 10 that raise and lower the hydraulic telescoping pipe table 6. The table base assembly 33 houses the telescoping roller assembly 34 with the steel rollers 35. The steel rollers 35 make smooth telescoping capability possible by allowing the tilting table top 36 to roll along the table base assembly 33. The tilting table top 36 is also configured to a maneuver the pipe lying on the hydraulic telescoping pipe table 6 to the desired side of the hydraulic telescoping pipe table 6. The tilting table top 36 facilitates the loading and unloading of pipe by rolling the pipe in the desired direction to maintain quick yet safe pipe preparation and handling. To facilitate the tilting of the tilting table top 36 two table tilting cylinders 37 are amounted to the trailer base 11. When the left table tilting cylinder 37 is extended the tilting table top 36 tilts to the right. Conversely, when the right table tilting cylinder 37 is extended the tilting table top 36 tilts to the left.

Figure 7:
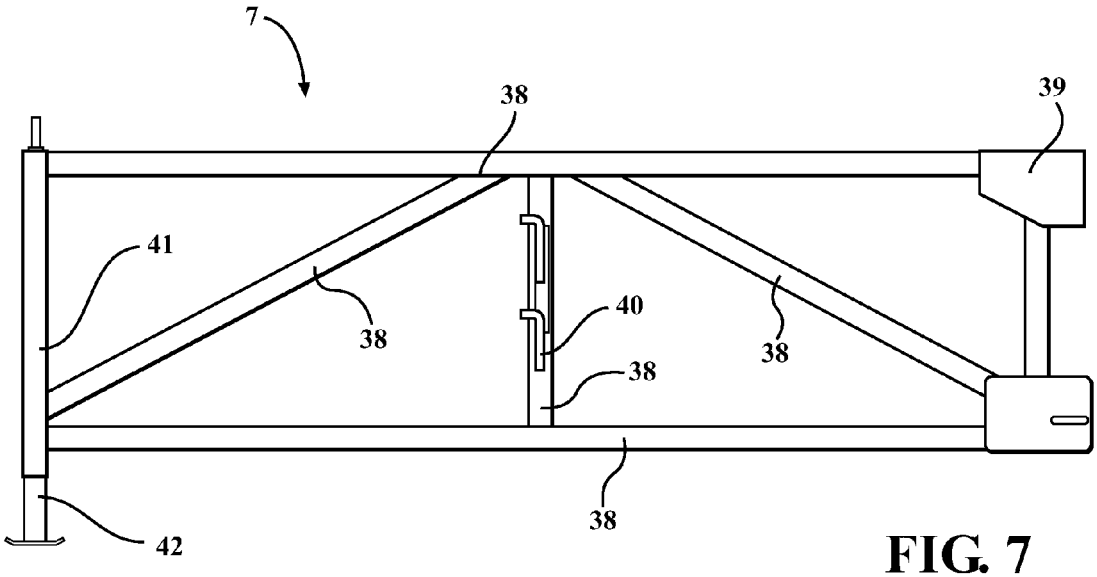
FIG. 7 is a front view of a hydraulic pipe rack.

The hydraulic pipe handling apparatus 1 additionally comprises hydraulic pipe racks 7. The function of the hydraulic pipe racks 7 is to facilitate the loading and unloading of the hydraulic telescoping pipe table 6. FIG. 7 is a front view of a hydraulic pipe rack 7. As depicted in FIG. 7, a the hydraulic pipe racks 7 include a pipe rack main frame 38 which safely and securely holds the pipe as it is being loaded or unloaded from the hydraulic telescoping pipe table 6. The hydraulic pipe racks 7 further comprise a pipe rack pivot assembly 39 that allows the pipe racks 7 to swing into the open position from a transport position. Pipe rack support bars 40 may be added to stabilize the pipe rack main frame 38 from movement while the hydraulic pipe handing apparatus 1 is in use. In the preferred embodiment, pipe rack hydraulic cylinders 41 are placed in the exterior vertical portion of the pipe rack main frame 38 to hydraulically adjust the pipe rack main frame 38 from −5 degrees, to level, then to +5 degrees and anywhere in between to stabilize the pipe or roll the pipe to the appropriate side of the pipe rack 7. A pipe rack foot assembly 42 may be attached to the pipe rack hydraulic cylinders 41 to secure the pipe rack hydraulic cylinder 41 for safe and reliable movement.

Figure 8:
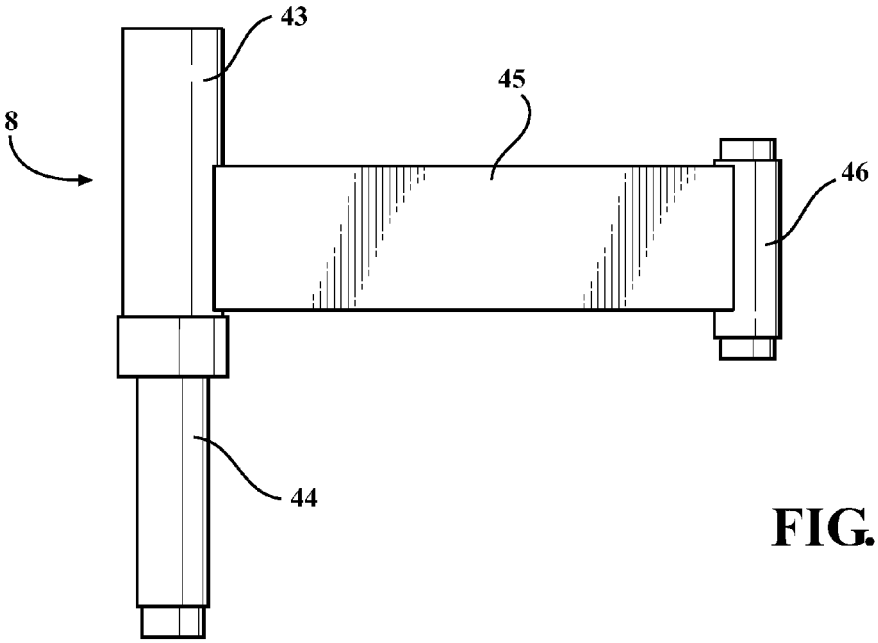
FIG. 8 is side view of a hydraulic leveling jack.

The hydraulic pipe handling apparatus 1 additionally comprises hydraulic leveling jacks 8. The function of the hydraulic leveling jacks 8 is to level and stabilize the hydraulic pipe handling apparatus 1 once it has been moved into position to deliver a load. FIG. 8 is a side view of a hydraulic leveling jack 8. As depicted in FIG. 8, the hydraulic leveling jack comprises an outside main jack cylinder 43 which houses the inside main jack cylinder 44 and connects to the main jack support 45. The inside main jack cylinder 44 is configured to hydraulically extend and retract to adjust and level the hydraulic pipe handing apparatus 1 when it is in position to deliver a load. The main jack support 45 may be constructed from steel tubing and facilitates the movement of the trailer 11 when the inside main jack 44 is engaged. Optionally, a jack pivot assembly 46 may be welded to the main jack support 45 to allow the hydraulic leveling jacks 8 to fold in toward the trailer 11 for transport.

Figure 9:
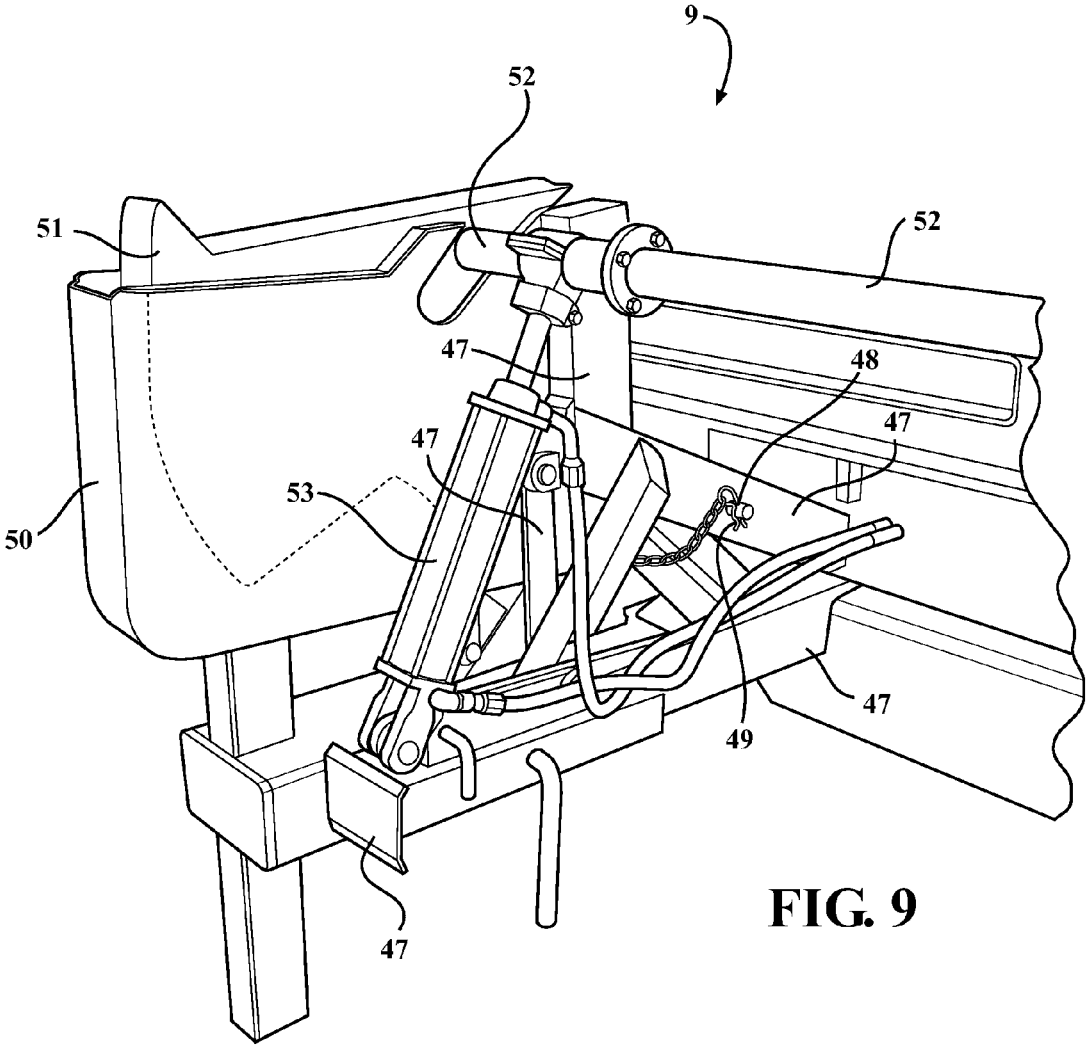
FIG. 9 is a perspective view of a hydraulic pipe loader.

The hydraulic pipe handling apparatus 1 additionally comprises hydraulic pipe loader 9. As depicted in FIG. 9, the hydraulic pipe loaders 9 are utilized to pick up a plurality of the pipe from the hydraulic pipe rack 7 and load it on to the hydraulic telescoping pipe table 6. In the preferred embodiment up to four (4) pipes at a time may be moved from the hydraulic pipe rack 7 and rolled onto the hydraulic telescoping pipe table 6 every time the hydraulic pipe loader 9 is extended. The hydraulic pipe loader 9 comprises a pipe loader main frame 47 which is attached to the trailer 11 and is equipped with holes 48 which are designed to accept pipe loader locking pins 49 that can be used to set the pipe loader 9 in the operating and transport positions. The hydraulic pipe loader 9 also has a pipe loader main shell 50 which is designed to receive pipe from the hydraulic pipe rack 7 and house the pipe loader swing arms 51. The pipe loader swing arms 51 are pivotally connect to the pipe loader main frame 47 and connected to the end of swing arm shaft 52. The swing arm shaft 52 is an elongated member that is connected to the swing arm at either end. The swing arm shaft 52 is also connected to at least one pipe loader hydraulic cylinder 53 which can be used to raise and lower the swing arm shafts 52 and in turn the pipe loader swing arms 51 affixed to each end of the shaft 52. When extended, the pipe loader swing arm 51 picks up and rolls the pipe onto the hydraulic pipe table 6. Optionally, the hydraulic pipe loader 9 can be adjustable to reduce the width of the hydraulic pipe handing apparatus 1. While in the upright position the hydraulic pipe loader 9 locks the pipe onto a hole in the pipe loader main frame 47 and while in the lowered position it locks into a second hole in the pipe loader main frame 47.

Figure 10:
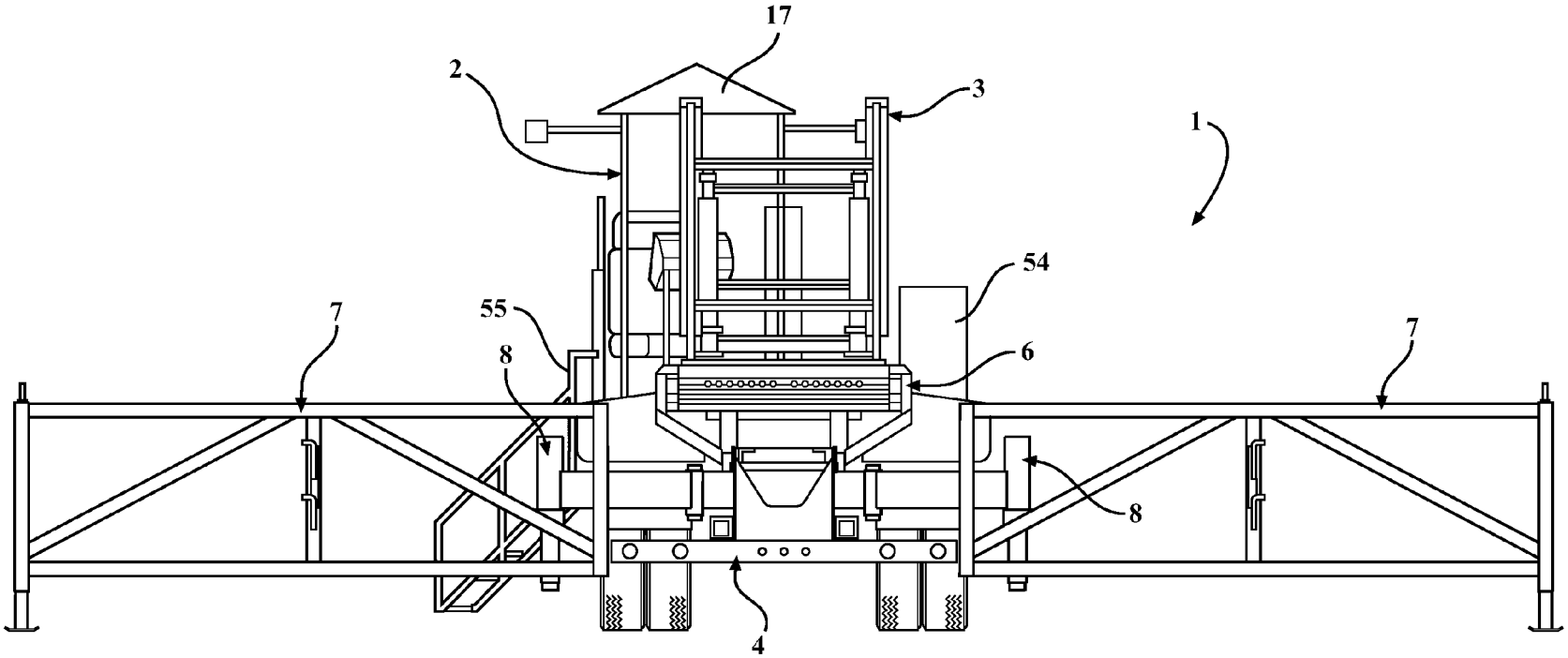
FIG. 10 is a front view of the hydraulic pipe handler apparatus in the lowered position.
Figure 11:
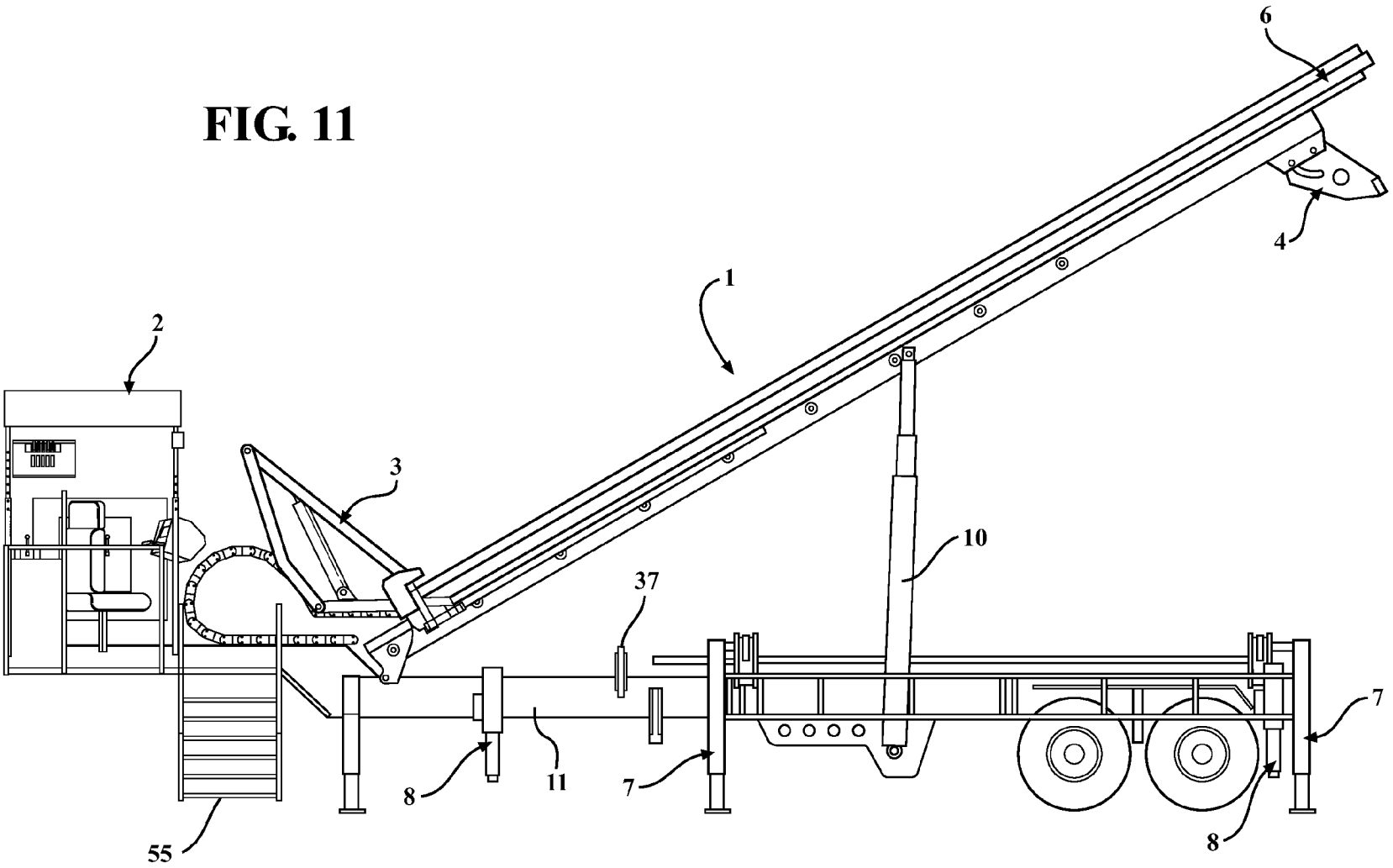
FIG. 11 is a side view of the hydraulic pipe handling apparatus with the hydraulic pipe table in the raised position.
Figure 12:
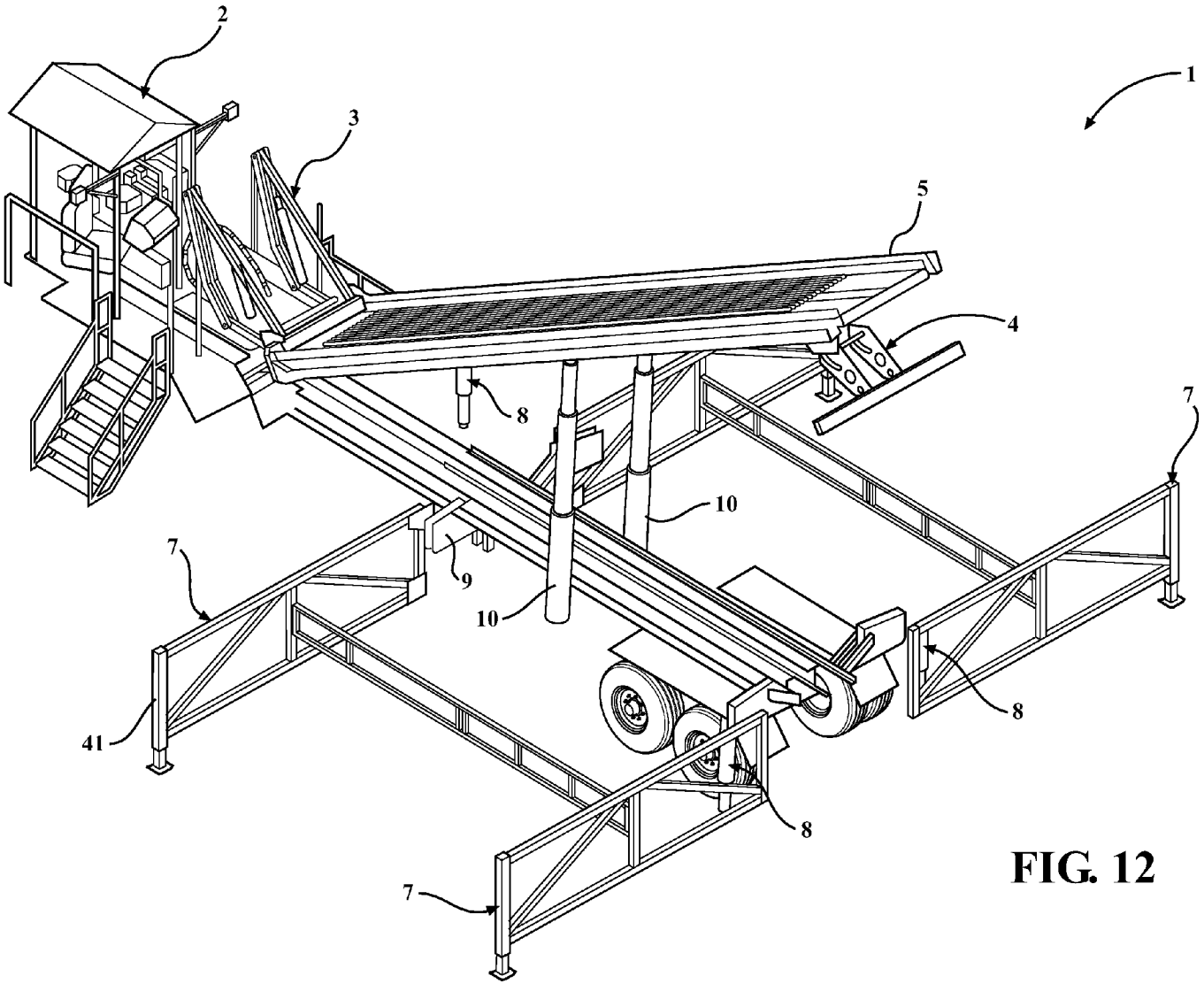
FIG. 12 is a perspective view of the pipe handling apparatus with the hydraulic pipe table elevated.
Figure 13:
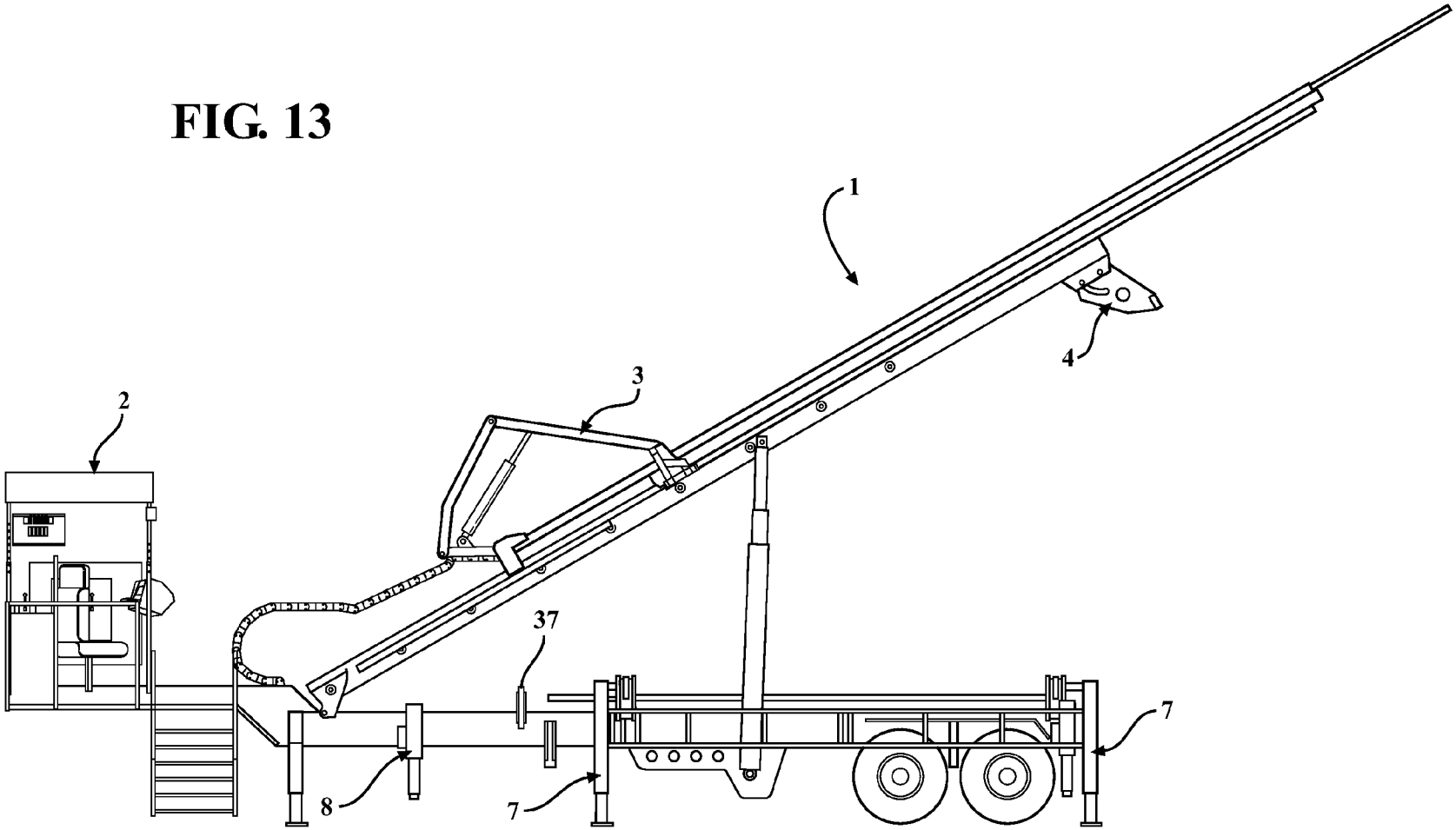
FIG. 13 is a side view of the pipe handling apparatus with the hydraulic pipe table elevated and the hydraulic pipe pusher extended to telescope the hydraulic pipe table to the work basket of a snubbing unit or workover rig.

FIG. 10 is a front view of the hydraulic pipe handler apparatus in the lowered position. The roof 17 is depicted covering the operator station 2 and is constructed from stainless steel. The pipe pusher 3 is depicted from the front view. In the preferred embodiment a hydraulic tank 54 is positioned to outside of the operator station 2 and is attached to the trailer 11. The hydraulic telescoping pipe table 6, bumper light bar 4, pipe racks 7 and leveling jacks 8 can be seen from the front view as well. Optionally, stairs 55 may be added to lead up to the operator station 2.

The abovementioned disclosure and description of this invention is illustrative and descriptive thereof. Various modifications to the details of the illustrated structure can be made within the scope of the attached claims without deviating from the true nature of this invention. This invention should only be limited by the following statements and their legal counterparts.

The invention claimed is:

1. A pipe handling apparatus comprising:

a moveable base for positioning the apparatus in a position suitable for delivering a load;

a hydraulic lift table connected at its rear to the movable base the hydraulic lift table having a unchanneled substantively level table top and hydraulically controlled left and right gates to secure the load wherein the left and right gates further comprise:

a main gate tube oriented parallel to the pipe table;

a plurality of pipe gate pivot assemblies that pivotally attach the main gate tube to the pipe table; and a pipe gate cylinder attached to the main gate tube that when extended causes the plurality pipe gate pivot assemblies to rotate so that the main gate tube drops below the surface of the pipe table;

a main lift cylinder for tilting the hydraulic lift table relative to the movable base at a selected angle; and a hydraulically driven pipe pusher assembly for moving the pipe vertically along the hydraulic lift table.

2. The pipe handling apparatus of claim 1, wherein the hydraulic lift table further comprises:

a table base assembly.

3. The pipe handling apparatus of claim 2, wherein the table base assembly further comprises:

a telescoping roller assembly that facilitates the vertical movement of the table top.

4. The pipe handling apparatus of claim 3, wherein the telescoping roller assembly further comprises:

a plurality of steel rollers.

5. The pipe handling apparatus of claim 1, wherein the hydraulic lift table further comprises:

tilting table top that rotationally moves to consolidate pipe against a pipe gate.

6. The pipe handling apparatus of claim 5, further comprising:

at least one table tilting cylinders that facilitates the rotational movement of the tilting table top.

7. The pipe handling apparatus of claim 1, wherein the hydraulic lift table further comprises:

a tail roller that is not connected to the pipe pusher assembly.

8. The pipe handling apparatus of claim 1, wherein the pipe pusher assembly further comprises:

a pipe pusher scissor main assembly;

a head assembly which engages pipe resting on the hydraulic telescoping pipe table; and a gantry assembly which facilitates the connection of the pipe pusher assembly to the hydraulic telescoping pipe table.

9. The pipe handling apparatus of claim 8, wherein the pipe pusher assembly further comprises:

a pipe pusher hydraulic cylinder which provides the pipe pusher assembly with hydraulically powered maneuverability.

10. The pipe handling apparatus of claim 9, wherein the pipe pusher assembly further comprises:

a hydraulic hose track to protect hydraulic hoses.

11. The pipe handling apparatus of claim 1, further comprising:

a plurality of hydraulic pipe racks connected to the moveable base that facilitate the loading and unloading of the hydraulic telescoping pipe table; and a plurality hydraulic pipe loaders that facilitate the transfer of pipe from the plurality of hydraulic pipe racks onto the hydraulic pipe table.

12. The pipe handling apparatus of claim 11, wherein the plurality hydraulic pipe loaders further comprise:

a pipe loader main frame;

a means for setting the pipe loader in the operating and transport positions;

a main shell designed to receive pipe from the hydraulic pipe rack; and a plurality of swing arms.

13. The pipe handling apparatus of claim 1, further comprising:

a plurality of hydraulic leveling jacks to level and stabilize the hydraulic pipe handling apparatus once it has been moved into position to deliver a load comprising:

an outside main jack cylinder which houses the inside main jack cylinder;

an inside main jack cylinder configured to hydraulically extend and retract;

a main jack support; and a jack pivot assembly configured to allow the jack to rotate toward the trailer for transport.

14. The pipe handling apparatus of claim 1, further comprising:

a hydraulic bumper light bar attached to the moveable base.

15. The pipe handling apparatus of claim 14, wherein hydraulic bumper light bar further comprises:

a main bumper bar;

lighting assemblies; and a main pivot shaft that facilitates the connection of the hydraulic bumper light bar to the movable base.

16. The pipe handling apparatus of claim 1, further comprising:

an operator station configured to allow the user to operate the pipe handing apparatus from a single location.

17. The pipe handling apparatus of claim 16, wherein the operator station further comprises:

hydraulic controls.

18. The pipe handling apparatus of claim 17, wherein the hydraulic controls include:

main elevation controls.

19. The pipe handling apparatus of claim 17, wherein the hydraulic controls include:

pipe rack hydraulic controls.

20. The pipe handling apparatus of claim 17, wherein the hydraulic controls include:

pipe pusher telescoping controls.

* * * * *